US005996808A

United States Patent [19]

Levy et al.

[11] Patent Number: 5,996,808

[45] Date of Patent: Dec. 7, 1999

[54] FLY ASH PROCESSING USING INCLINED FLUIDIZED BED AND SOUND WAVE AGITATION

[76] Inventors: Edward Kenneth Levy, 1030 Raymond Ave., Bethlehem, Pa. 18018; James Walter Parkinson, 2440 Treese Ave., Indiana, Pa. 15701; Barbara Jean Arnold, 532 Route 66, Apollo, Pa. 15613; John Sigmund Salmento, 713 Porter St., Easton, Pa. 18042

[21] Appl. No.: 08/834,540

[22] Filed: Mar. 4, 1997

Related U.S. Application Data

[60] Provisional application No. 60/012,835, Mar. 5, 1996.

[51] Int. Cl.[6] ..... B07B 4/00

[52] U.S. Cl. ..... 209/474; 209/20; 209/475; 209/590

[58] Field of Search ..... 209/3, 12.1, 44, 209/474, 475, 490, 492, 502, 20, 590

[56] References Cited

U.S. PATENT DOCUMENTS

| | | | |
|---|---|---|---|
| 2,060,966 | 11/1936 | Allard | 209/474 |
| 3,831,747 | 8/1974 | Scott et al. | 209/474 X |
| 3,905,556 | 9/1975 | Drage | 209/44 X |
| 4,755,284 | 7/1988 | Brooks et al. | 209/474 X |
| 4,919,807 | 4/1990 | Morton et al. | 209/173 X |
| 5,197,398 | 3/1993 | Levy et al. | 209/474 X |

FOREIGN PATENT DOCUMENTS

| | | | |
|---|---|---|---|
| 545672 | 9/1957 | Canada | 209/474 |
| 2078552 | 1/1982 | United Kingdom | 209/474 |

*Primary Examiner*—Tuan N. Nguyen
*Attorney, Agent, or Firm*—Law Offices of Royal W. Craig

[57] ABSTRACT

A process and device for separating different types of particulates from a mixture, which is especially suited for separating unburned carbon from raw fly ash. The process entails separating raw fly ash by size into a fine component and a coarse component (the coarse component having typically higher levels of unburned carbon). The coarse, high carbon, fly ash component (or optionally both components) are processed through an inclined fluidized bed to produce an upgraded coarse component with reduced unburned carbon. An acoustic field is imposed on the inclined fluidized bed(s) in order to enhance the bed's ability to fluidize and segregate the unburned carbon. The upgraded coarse and fine components are then mixed to yield a final product.

17 Claims, 13 Drawing Sheets

Effect of SPL on %LOI Recovery

LOI Reduction versus Mass Recovery at two different sound frequencies

FLY ASH PROCESSING USING INCLINED FLUIDIZED BED AND SOUND WAVE AGITATION

CROSS-REFERENCE TO RELATED APPLICATIONS

The present application claims priority from U.S. Provisional Application Ser. No. 60/012,835, filed Mar. 5, 1996, and entitled "Fly Ash Processing".

FIELD OF THE INVENTION

The present invention relates to the separation of materials and, more particularly, to a process for separating different types of particulates, e.g., carbon from fly ash, using an improved inclined fluidized bed approach with acoustic enhancement.

BACKGROUND OF THE INVENTION

In a typical pulverized coal power plant, 80 percent of the ash is carried from the boiler as fly ash and is removed from the flue gas in an electrostatic precipitator, fabric filter or wet scrubber. As a result. U.S. electric utilities spend about $1 billion annually to dispose of most of the 75 million tons of ash removed from their pulverized coal burning plants. For this reason, there has been worldwide activity for many years on the development of ways of utilizing fly ash as an alternative to ash disposal. One of the high volume end uses which has found commercial acceptance is the substitution of fly ash for some of the cement used in concrete.

However, in addition to containing a variety of inert minerals, fly ash may also contain undesirable amounts of unburned carbon. High levels of unburned carbon in fly ash are common with bituminous coals burned in both comer-fired and wall-fired pulverized coal boilers. High levels of unburned coal are even more severe when low NOx burners are used for NOx control. Many utilities who wish to sell their fly ash for use in concrete must reduce these levels of fly ash carbon at high cost. Although over 56 million tons of cement were used to produce concrete in the U.S. in 1991, only approximately 7 million tons of fly ash went into U.S. concrete due to the cost of carbon removal.

One of the standard laboratory tests for the amount of unburned carbon in fly ash is the so-called loss-on-ignition test (LOI). In this disclosure, the terms LOI and unburned carbon will be used interchangeably. The amount of LOI is influenced by the size distribution of coal leaving the coal pulverizers, the combustion conditions in the furnace and the design of he furnace and the burners. For utility boilers burning bituminous coal, utilities have traditionally tried to maintain the LOI in the fly ash to below 6 weight percent. This is done to prevent excessively large losses in boiler efficiency. But for many boilers, this has not been an easy goal to meet. For those utilities who wish to sell their fly ash for use in concrete, it is necessary to maintain the fly ash carbon to even lower levels, with limits of 3 to 5 percent carbon content usually imposed by the concrete manufacturers. Utilities are now installing low NOx burners on their boilers for NOx control. However, as described above, this escalates the problem of fly ash LOI. Test data resulting from recent low NOx installations show that operating a boiler with low NOx burners invariably results in an increase in fly ash LOI, sometimes two-fold in extent.

Thus, there remains a commercial need for an industrial process which beneficiates fly ash in an economical manner, thus making it more amenable to reuse in concrete and otherwise. The problem lies in the separation and removal of carbon from fly ash.

One proposed solution is described in U.S. Pat. No. 5,299,692 issued to Nelson et al. This approach uses an inclined vibrating bed for reducing carbon content. However, this vibratory method was shown to result in 10–80% weight reduction of the carbon content in fly ash. As described above, it is necessary to reduce fly ash carbon to even lower levels on the order of 3 to 5 percent carbon content in accordance with requirements imposed by the concrete manufacturers.

There are analogous methods of particulate separation which have been used for other purposes. For instance, a proven method to achieve separation of pyritic sulfur and ash from the clean portion of coal uses a bubbling fluidized bed operating at room temperature and atmospheric pressure.

FIG. 1 illustrates a bubbling (or gas) fluidized bed 1. At flow rates above minimum fluidization ($U_{mf}$), some of the gas flows through the bed from bottom (Z=0) to top (Z=L) in the form of voids of gas or bubbles. As these bubbles move upward through the bed, they cause agitation and motion of the solids, leading to circulation of solid material in the axial direction. When particles of different densities and sizes are contained in the fluidized bed 1, there is a tendency at near minimum bubbling conditions for the solids to stratify in the vertical direction Z according to density, and to a lesser extent, size. When the fluidized bed is used for separating pyritic sulfur and ash from the clean portion of crushed coal, the clean fraction of the coal segregates at the top of the bed, with the liberated coal mineral particles settling towards the bottom. As a consequence, the pyrite content of the coal at the top of the bed (near Z=L) is lowered, thereby permitting recovery of coal with substantially reduced amounts of pyrite. This is shown graphically in FIGS. 2–3, which graphs represent the vertical variation of coal and ash. respectively, after processing in a fluidized bed 1 (as a function of vertical position within the bed).

Specifically, FIG. 2 is a graphical illustration of the local coal concentration (%) as a function of the vertical position Z along the bed 1. It can be seen that the coal concentration increases toward the top of the bed (near Z=L).

FIG. 3 is a graphical illustration of the local ash content of the coal (%) as a function of the vertical position Z along the bed 1. The ash content increases toward the bottom of the bed (near Z=0).

In summary, the clean coal fractions stratify at the top of the bed (Z=L) with the pyrite and ash concentrated toward the bottom (Z=0), and it only remains to separate the clean coal and remove the pyrite and ash concentrations.

An improved continuous process for cleaning coal is disclosed in U.S. Pat. No. 5,197,398. This process, referred to as D-CoP, relies on an inclined fluidized bed (shown in FIG. 4 herein). This type of bed resembles a long, nearly horizontal, table, with fluidizing air passing vertically upward through a distributor causing bubbling to occur in the bed material. The coal and magnetite, which arc added to the bed at one end via coal feed and magnetite feed, flow along the length of the bed, and as they do so, the pyrite and other minerals sink downward through the layer of particles. The clean coal with some magnetite is then separated from the coal refuse at the discharge end. The D-CoP process relies on the use of a bubbling fluidized bed to achieve separation of particles based on differences in density. The bubbles, which are formed at the distributor located at the bottom of the bed, act as pumps. They carry material upward from the bottom of the bed, and at the same time, provide a mechanism by which relatively dense particles near the top of the bed can move downward. Thus, the ability to achieve stable bubbling fluidization is central to the good separation efficiencies which are achieved by D-CoP when used for cleaning coal.

In order to apply this fluidized bed approach to fly ash, it is necessary to achieve good bubbling fluidization. However, fly ash particles are relatively small in size, with mean particle diameters which are typically less than 15 to 20 microns. Particles in this size range do not fluidize well in the bubbling mode. Instead, the particles tend to clump together, causing an unsteady slugging type of fluidization.

In 1994, S. Mori and T. Sawa from Nagoya University in Japan published a paper in Japanese entitled "*Development of a Coal Fly Ash Upgrading Process.*" That paper describes the use of a fluidized bed approach to beneficiate fly ash. However, in the Mori approach, two fluidized beds are used, the first to achieve a size segregation of the fly ash, and the second to process the fine fraction and achieve a density segregation of this material. To deal with the interparticle forces, Mori and Sawa use a mechanically agitated (vibrated) fluidized bed, which is vibrated at a frequency of 25 Hz. The carbon rises towards the top of this mechanically agitated bed and is removed by suction. Mori does not teach the advantages of using an inclined fluidized bed, and the need for mechanical agitatation results in high capital and operating costs.

There remains a need for a viable industrial process to separate materials with particle diameters in this range, and it is herein disclosed how an improved approach for separating, e.g., carbon from fly ash, using an inclined fluidized bed can achieve the desired result.

It is additionally possible to attain even better separation by supplemental acoustic separation.

There has been some previous work on the use of an acoustic field to enhance the fluidization of fine particles. For instance, Chirone et al., *Bubbling "Fluidization of a Cohesive Powder in an Acoustic Field," Fluidization VII, Engineering Foundation,* (1992), studied bubbling fluidization of a cohesive powder (1 to 45 microns) in an acoustic field. This study reported that the large clusters responsible for the tendency of the powder to spout became converted into fluidizable sub-clusters by the acoustic field, thus making it possible to achieve stable bubbling conditions. Chirone et al. used sound intensity levels in the range of 120 to 150 dB with a frequency of 190 hertz.

Nowak et al., *"Fluidization and Heat Transfer of Fine Particles in an Acoustic Field," Fluid-Particles Processes: Fundamentals and Anclications, AIChE Symposium Series No.* 296, Volume 89, (1993), found similar beneficial effects of an acoustic field on the fluidization of cohesive powders with sound pressure levels ranging from 100 to 130 DB being required to achieve the desired effect.

To date, there have been no efforts to determine the effect of the acoustic field on those properties of the bubbles which affect solids mixing and segregation.

It would be greatly advantageous to provide an improved industrial process to separate materials with smaller particle diameters such as fly ash using an inclined fluidized bed approach with optional acoustic enhancement. This would allow economical beneficiation of these particulates, thus making them more amenable to reuse (such as fly ash for concrete and other uses).

SUMMARY OF THE INVENTION

In accordance with the above, it is an object of the present invention to provide an improved industrial process to separate materials with smaller particle diameters such as fly ash using an inclined fluidized bed approach. This would allow economical beneficiation of these particulates, thus making them more amenable to reuse (such as fly ash for concrete and other uses).

It is another object to further beneficiate the fly ash by use of an acoustic field to enhance the fluidization of these fine particulates, thereby making the fly ash more amenable to reuse in concrete and otherwise.

It is a further object to provide an inclined fluidized bed approach with optional acoustic enhancement as described above for separating almost any other type of particulates into low density and high density components.

The above and other objects and advantages of the invention will become more readily apparent on examination of the following description including the drawings, in which like reference numerals refer to like parts. Generally, the improvement disclosed herein includes a process and device for separating different types of particulates from a mixture, which is especially suited for removing unburned carbon from fly ash. The process entails separating raw fly ash by size into a fine component and a coarse component (the coarse component having, typically higher levels of unburned carbon). The coarse, high carbon, fly ash component (or optionally both components) is processed through an inclined fluidized bed to produce an upgraded component with reduced unburned carbon. The upgraded coarse and fine components are then mixed to yield a final product.

A supplemental step of imposing an acoustic field on the inclined fluidized bed is also disclosed in order to enhance the bed's ability to fluidize and segregate the unburned carbon.

BRIEF DESCRIPTION OF DRAWINGS

FIG. 8B shows how the low LOI fraction may be removed from the bed material at discharge 260 through slots in the distributor 250.

FIG. 8C shows how the high LOI material can be removed from the top of the bed by a pneumatic suction device 280.

FIG. 8D shows how a splitter plate 285 can be used to separate the high LOI component from the low LOI component as they are both discharged from the bed.

DETAILED DESCRIPTION OF THE PREFERRED EMBODIMENTS

The ability to separate the carbon from the fly ash depends on the way in which it is distributed within the ash. In some cases, almost all of the carbon is contained in particles which are 40 microns and above. This trend is apparently fairly common in nature and applies to a wide range of fly ash materials, thus making it much easier to utilize a fluidized bed process as described herein for fly ash beneficiation. The other significant question dealing with the properties of the fly ash involves the issue of whether or not the carbon is firmly attached to the inert part of the fly ash or whether it is contained as liberated carbon particles. In Moiset, "*The Recovery of Carbon Contained in Fly Ash Given Off by Electric Power Plants," Proceedings Fifth Int'l Coal Preparation Congress,* fly ash samples from power plants in Belgium were examined, and it was reported that the carbon was largely liberated.

Fly ash has a wide size distribution and the efficiency of separation is improved if the fly ash is first divided (or classified) into two or more parts by size. In the case where it is divided into two size ranges, at least the coarser fraction, which is usually richer in unburned carbon, should be processed in an inclined fluidized bed. Of coarse, as will be described, both fractions may be processed in two fluidized beds. It is envisioned that conventional screen-type sieves or aerodynamic classifiers can be used to achieve the initial size separation.

Figure 1:
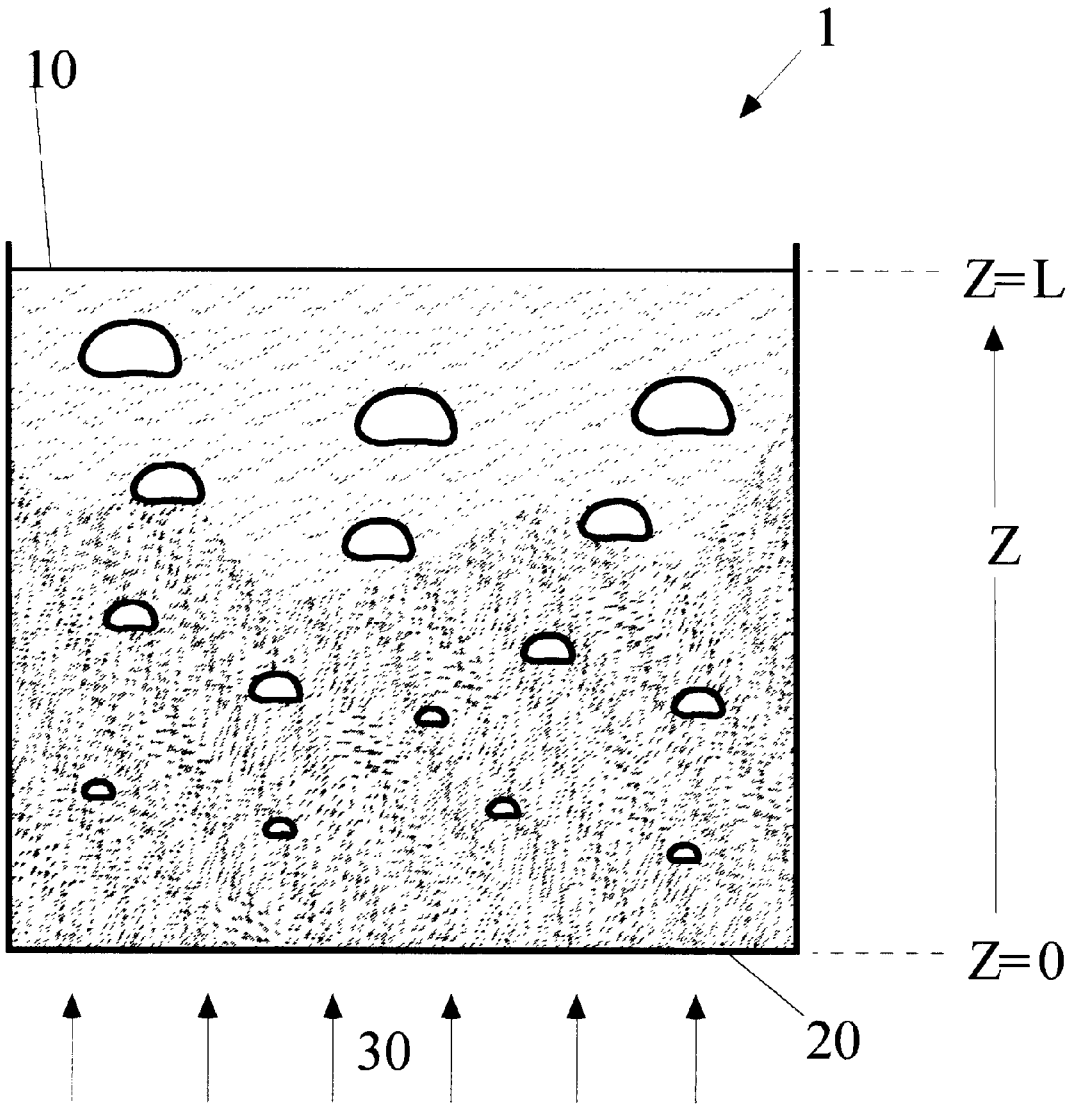
FIG. 1 illustrates a typical bubbling (or gas) fluidized bed 1.
Figure 2:
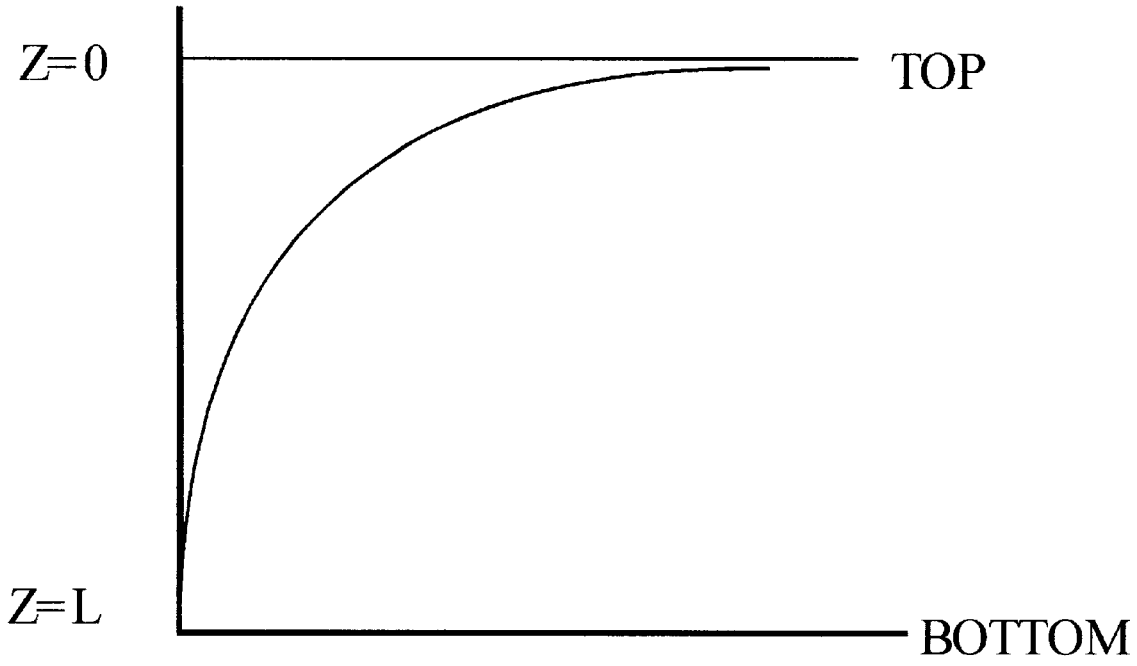
FIG. 2 is a graphical illustration of the local coal concentration (%) as a function of the vertical position Z along the bed 1.
Figure 3:
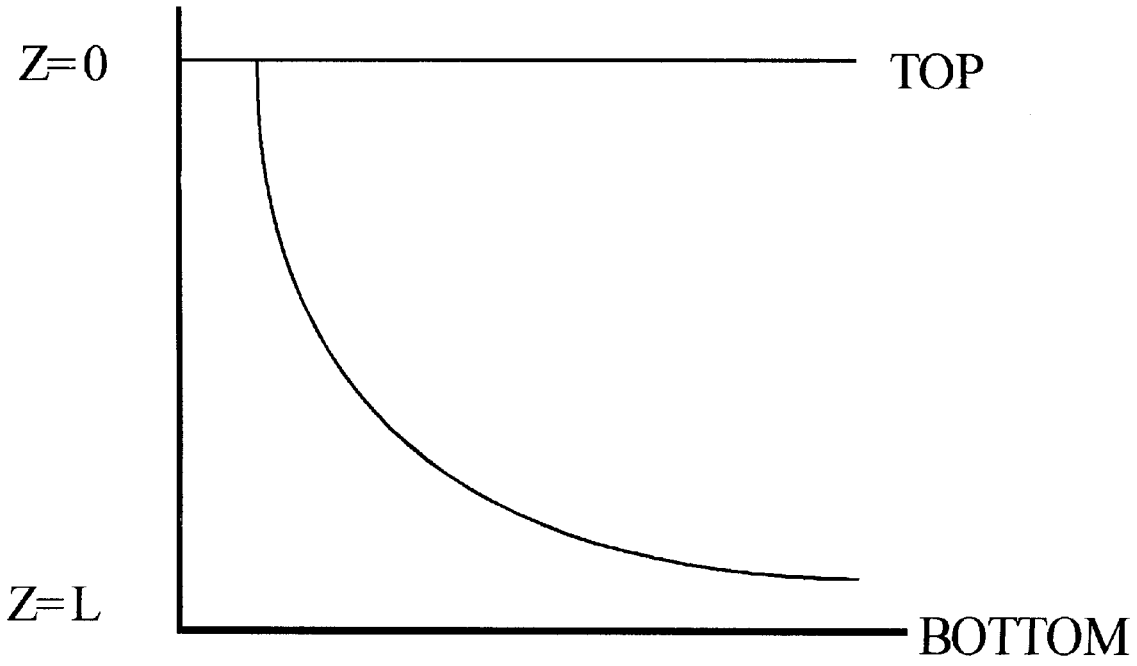
FIG. 3 is a graphical illustration of the local ash content of the coal (%) as a function of the vertical position Z along the bed 1.
Figure 4:
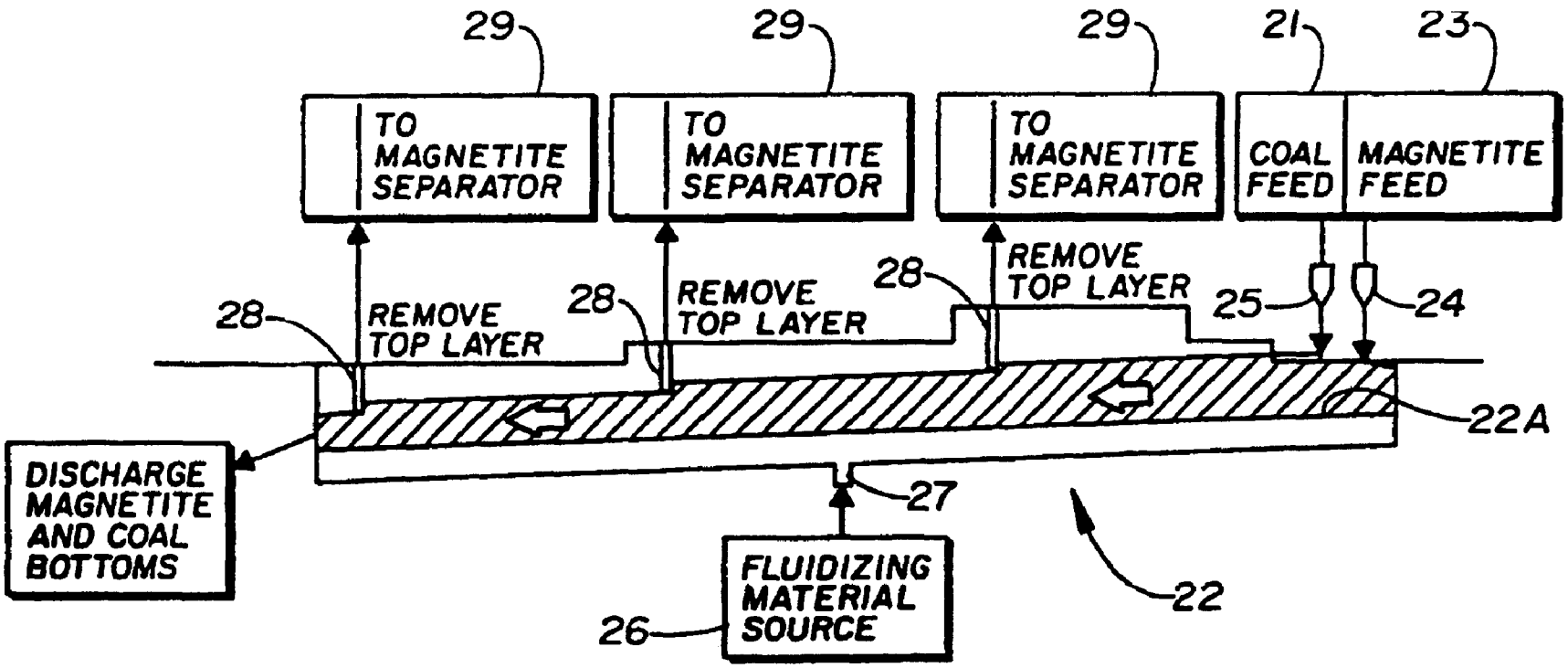
FIG. 4 shows the prior art process for cleaning coal as disclosed in U.S. Pat. No. 5,197,398 (this process being referred to as D-CoP).
Figure 5:
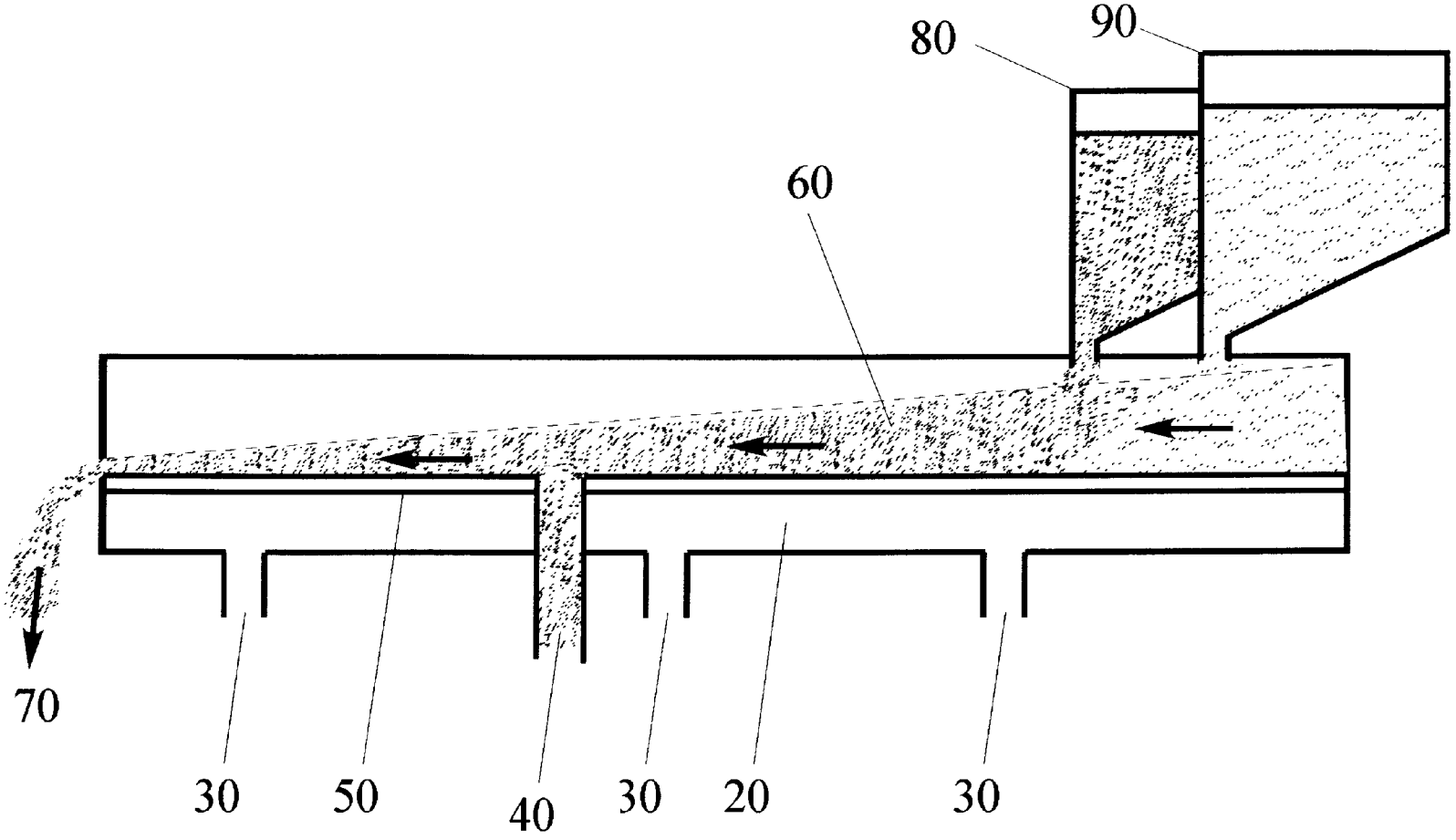
FIG. 5 illustrates a conventional inclined fluidized bed for continuous removal of pyrite from coal.

FIG. 5 illustrates a conventional inclined fluidized bed for continuous removal of pyrite from coal. The inclined fluidized bed is similar to a long nearly horizontal table. The feed materials are added at one end (magnetite by hopper 90 and coal by hopper 80), and the product and refuse streams are removed from the other end at discharge 70. Air is fed through inlets 30 into an air plenum 20 and is bubbled up through the material via distributor 50. As the material flows along the length of the bed, segregation occurs, with the dense fractions settling downward toward the distributor 50 and the lightest components rising to the top of the bed. Previous studies have shown that the flow characteristics of a powder on an inclined bed depend very much on particle size distribution.

In order to apply the fluidized bed approach to fly ash, the raw fly ash mixture is introduced into the inclined fluidized bed as described above. The mixture is processed along the fluidized bed to achieve bubbling fluidization of the particles and to thereby cause segregation, e.g., a dense fraction settles downward and a light fraction rises upward in the bed. The lighter fraction, which is usually richer in unburned carbon, is separated from the denser fraction. The key here is to achieve good bubbling fluidization. Fly ash particles are relatively small in size, with mean particle diameters which are typically less than 15 to 20 microns. Particles in this size range do not fluidize well in the bubbling mode. Instead, the particles tend to clump together. causing an unsteady slugging type of fluidization. For this reason, it is preferable to enhance the fluidization in the bubbling mode, and to prevent the particles from clumping together.

In accordance with the present invention, the above-described enhancement may be acoustic in nature. The dramatic effect of high intensity sound on bubbling with particulates such as fly ash is employed to enhance the beneficiation process. Sound affects characteristics such as bubble size distribution, shape, and wake configuration and bubble frequency. Test results have shown the propensity of imposing an acoustic field on a bed of fine fly ash to enhance its ability to be fluidized and segregated in a bubbling fluidized bed. Sound waves agitate the bed material and disrupt the interparticle forces. This promotes more uniform and consistent bubbling in the bed and thus enhances the segregation processes in the bed which are needed to achieve efficient separation of carbon.

Figure 6:
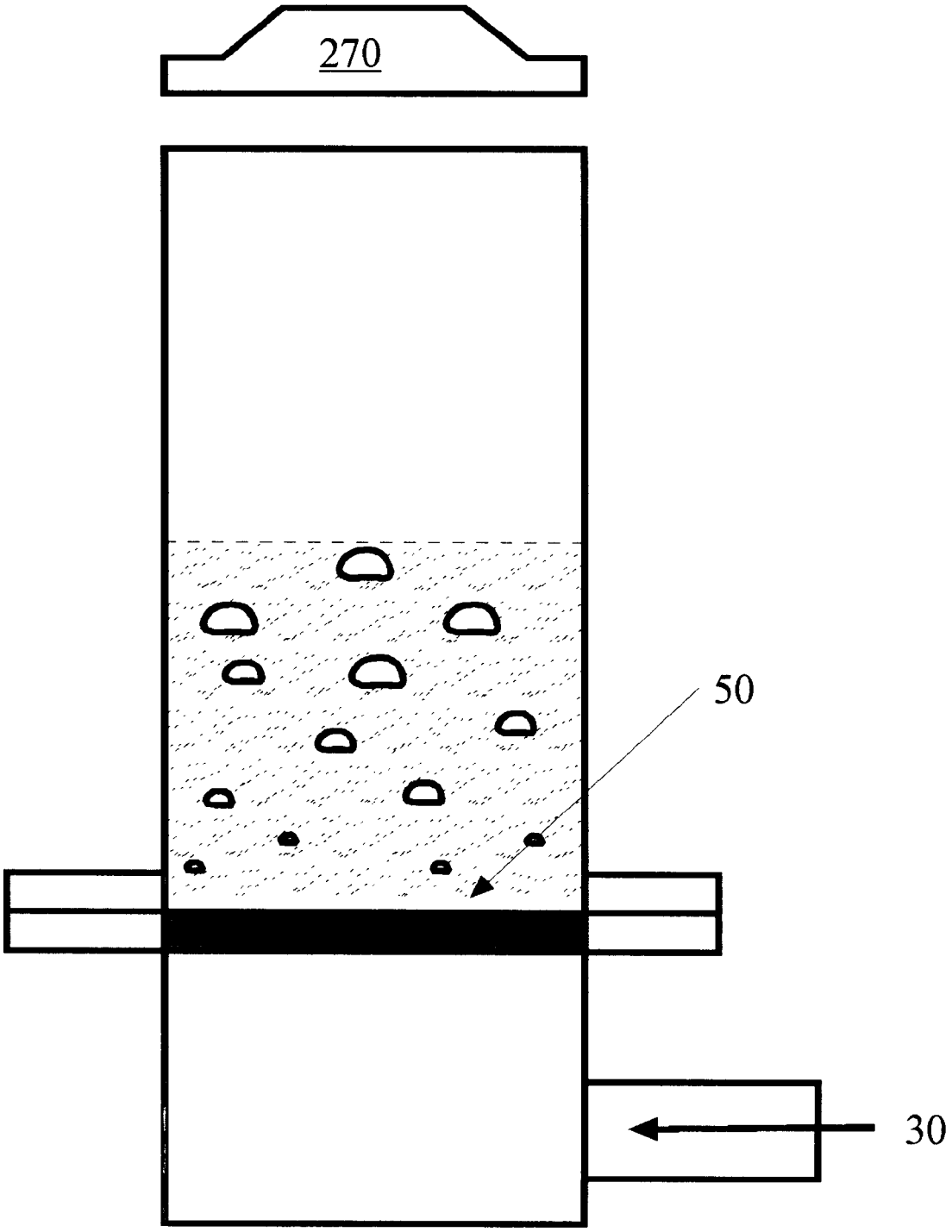
FIG. 6 illustrates how a loudspeaker 270 may be oriented with respect to the fluidized bed to produce the requisite acoustic excitation.

FIG. 6 illustrates how a loudspeaker 270 may be oriented with respect to the fluidized bed to produce the requisite acoustic excitation.

The speaker(s) 270 may be any conventional loudspeaker (s) capable of generating the requisite Sound Pressure Level (SPL) in dB and frequencies (Hz). The speaker(s) 270 should be mounted above the bed and are preferably operated at power levels which generate values of SPL in excess of 140 dB at the free surface of the fluidized bed. Sound frequencies of approximately 90 Hz are presently preferred, though this may vary. Both sound frequency and sound intensity are important as will be apparent from experiments to be described.

Figure 7:
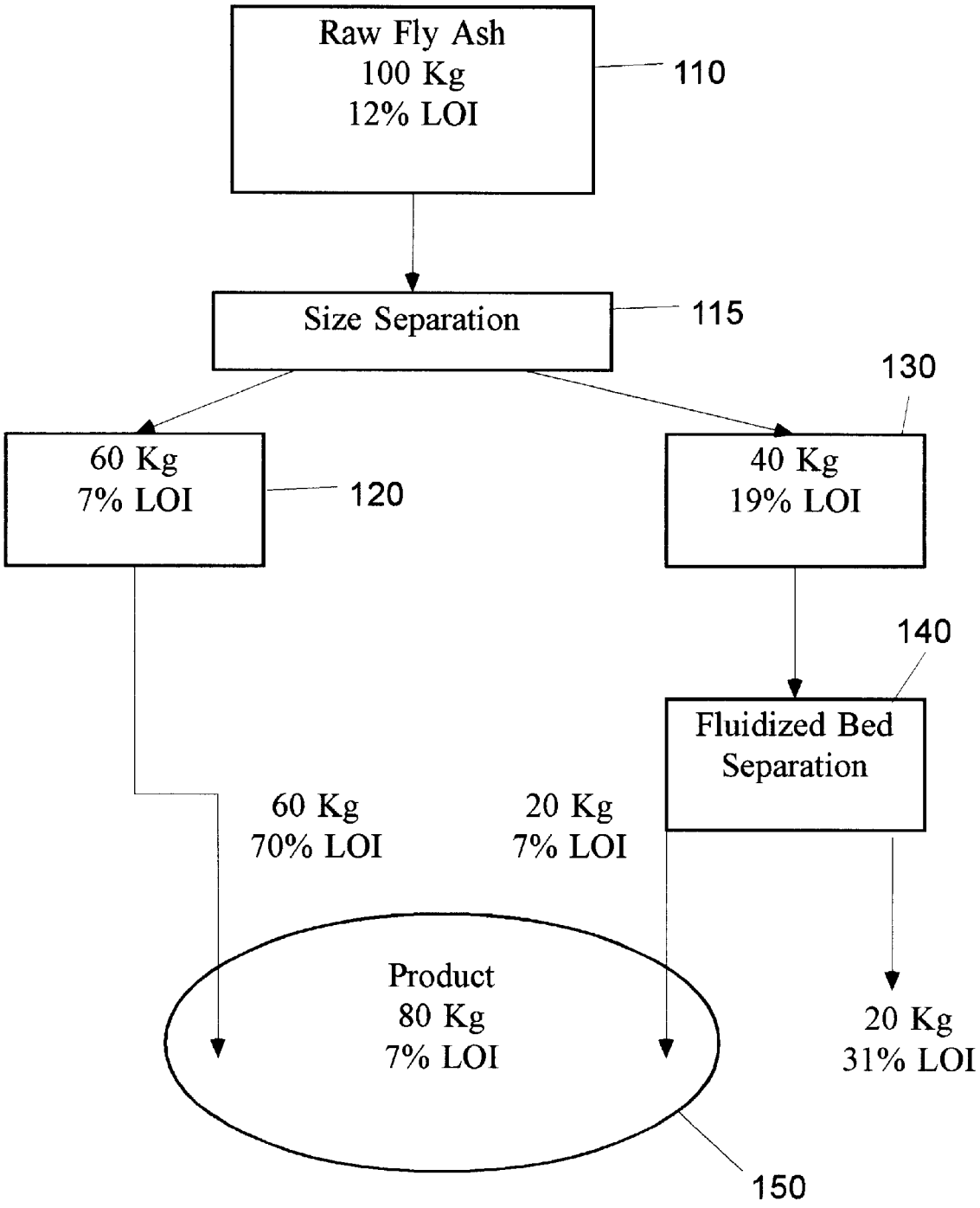
FIG. 7 is a flow diagram illustrating the separation process in accordance with one embodiment of the present invention.

FIG. 7 is a flow diagram illustrating the separation process in accordance with the present invention. Beginning with the raw fly ash (e.g., 100 kg at 12% LOI) at step 110, the process entails initial classification of the fly ash by size at step 115. The fly ash is classified and separated into two components, including a fine component comprising approximately 60 kg of 7% LOI fly ash, and a coarse component. The coarse fly ash as shown at step 130 has typically higher levels of unburned carbon on the order of about 19% LOI. The fine fly ash at step 120 is then sent directly to the ash product bin at step 150 for subsequent mixing with upgraded coarse fly ash. The coarse, high carbon, fly ash from step 130 is processed through a bubbling fluidized bed at step 140. Preferably, loudspeakers 270 (as in FIG. 6) are employed in conjunction with the fluidized bed to add acoustic excitation, and this is described more fully below (it is noteworthy that the process of the present invention may be carried out with or without acoustic enhancement). The resulting coarse upgraded fly ash (with an acceptably low level of carbon) is then mixed with the fine, low carbon fly ash stream at step 150 to produce 80 kg of final product with an LOI of 7 percent.

FIGS. 8A–D show how loudspeakers 270 (as in FIG. 6) may be employed in conjunction with a fluidized bed to add acoustic excitation in accordance with the present invention for use in classifying with smaller particles such as fly ash (step 140 above). Generally, ash is fed to the bed at one end and two streams are removed at the other end, one of which is rich in unburned carbon, the other containing relatively small concentrations of unburned carbon. Fly ash has a wide size distribution. In order to achieve a good separation of carbon from the inert parts of the fly ash, in some cases it will be necessary to separate the fly ash into two or more parts by size. This may be accomplished either by sieving or use of an aerodynamic classifier. Either pure ash can be fed to the bed for processing, or ash and magnetite or some other material can be fed to enhance separation (as is done for coal beneficiation). For some, if not all, fly ash materials, fluidization will be difficult to achieve due to the fineness of the particles.

The beds of FIGS. 8A–D are all well-suited for use in continuously processing the coarse high carbon, fly ash (from step 130 of FIG. 7) in accordance with step 140. Again, these are inclined fluidized beds similar to a long nearly horizontal table. The fly ash (or other feed material) is added at one end by hopper 240, a refuse stream is removed from the bed material at discharge 255, and the product stream is removed at discharge 260. Air is fed through air plenum 220 and is bubbled up through the material. The bubbles, which are formed at a distributor 250 located at the bottom of the bed, act as pumps. They carry material upward from the bottom of the bed, and at the same time, provide a mechanism by which relatively dense particles near the top of bed can move downward. The ability to achieve this stable bubbling fluidization is central to the good separation efficiencies which are achieved by the process described herein when used for cleaning fly ash. As the fly ash flows along the length of the bed, segregation occurs, with the dense fractions settling downward toward the distributor 250 and the lightest components rising to the top of the bed.

One or more speaker(s) 270 as described above are mounted above the bed and are preferably operated at power levels which generate values of SPL in excess of 140 dB at the free surface of the fluidized bed. Sound frequencies of approximately 90 Hz are presently preferred, though this may vary. Both sound frequency and sound intensity are important as will be apparent from experiments to be described. As the fly ash flows along the length of the bed, operation of the speakers 270 enhances segregation of the high and low LOI fractions.

The high and low LOI fractions may be removed or separated from the bed material at discharges 260 and 255.

Removal or separation can be accomplished through a variety of existing removal processes.

Figure 8A:
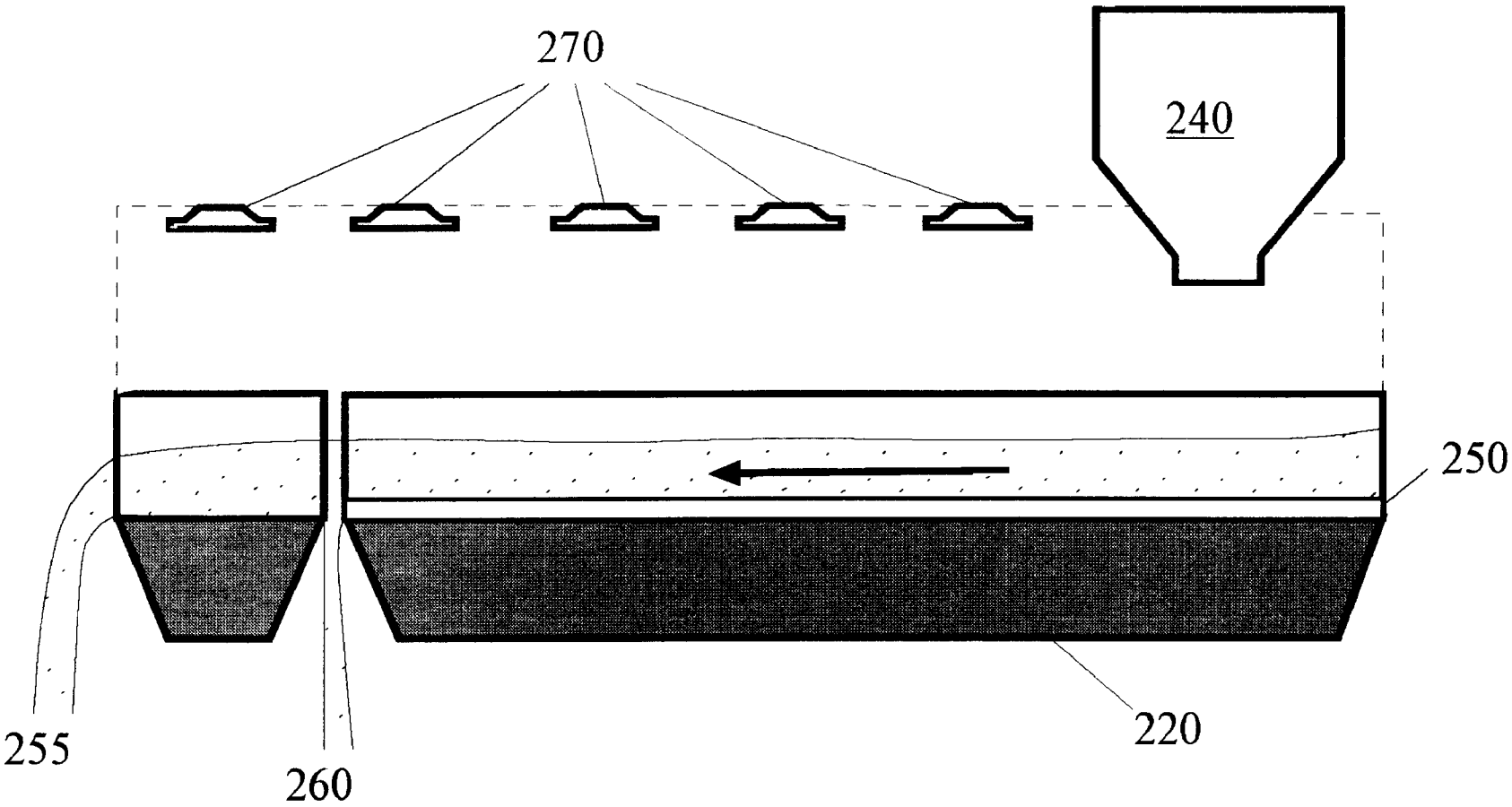
FIGS. 8A–D show adaptations of the bed of FIG. 5 with the addition of loudspeaker(s) as in FIG. 6 in accordance with the present invention for use in carrying out the process of FIG. 7 in classifying smaller particles such as fly ash. Removal or separation of the high and low LOI components can be accomplished through a variety of existing removal processes, and the examples of FIGS. 8A–D illustrate exemplary removal processes.
Figure 8B:
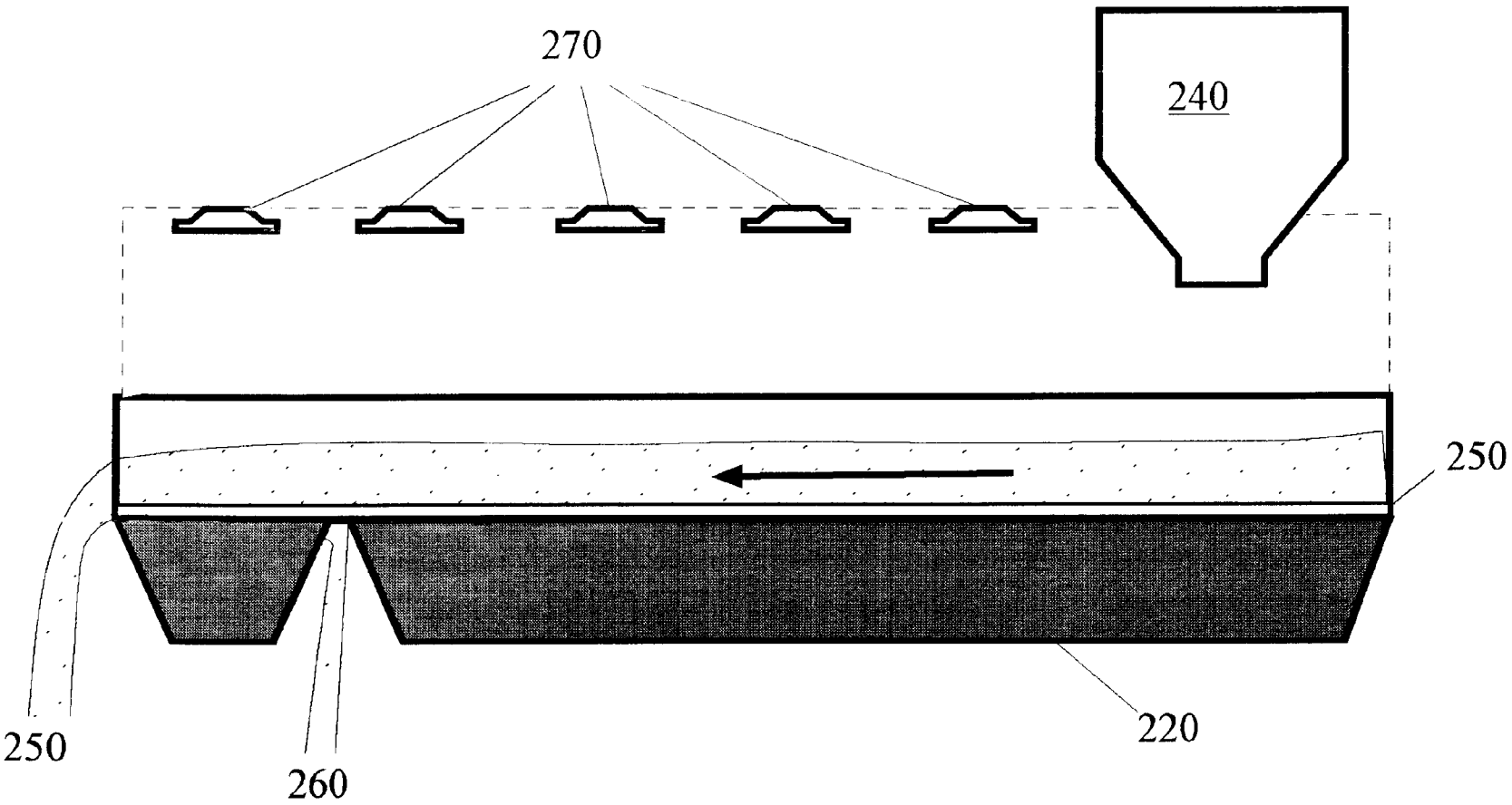

For example, as shown in FIG. 8B, the low LOI fraction 260 may be removed from the bed material at discharge 265 through slots in the distributor 250, the high LOI material 255 continuing past the slots to discharge 275.

Figure 8C:
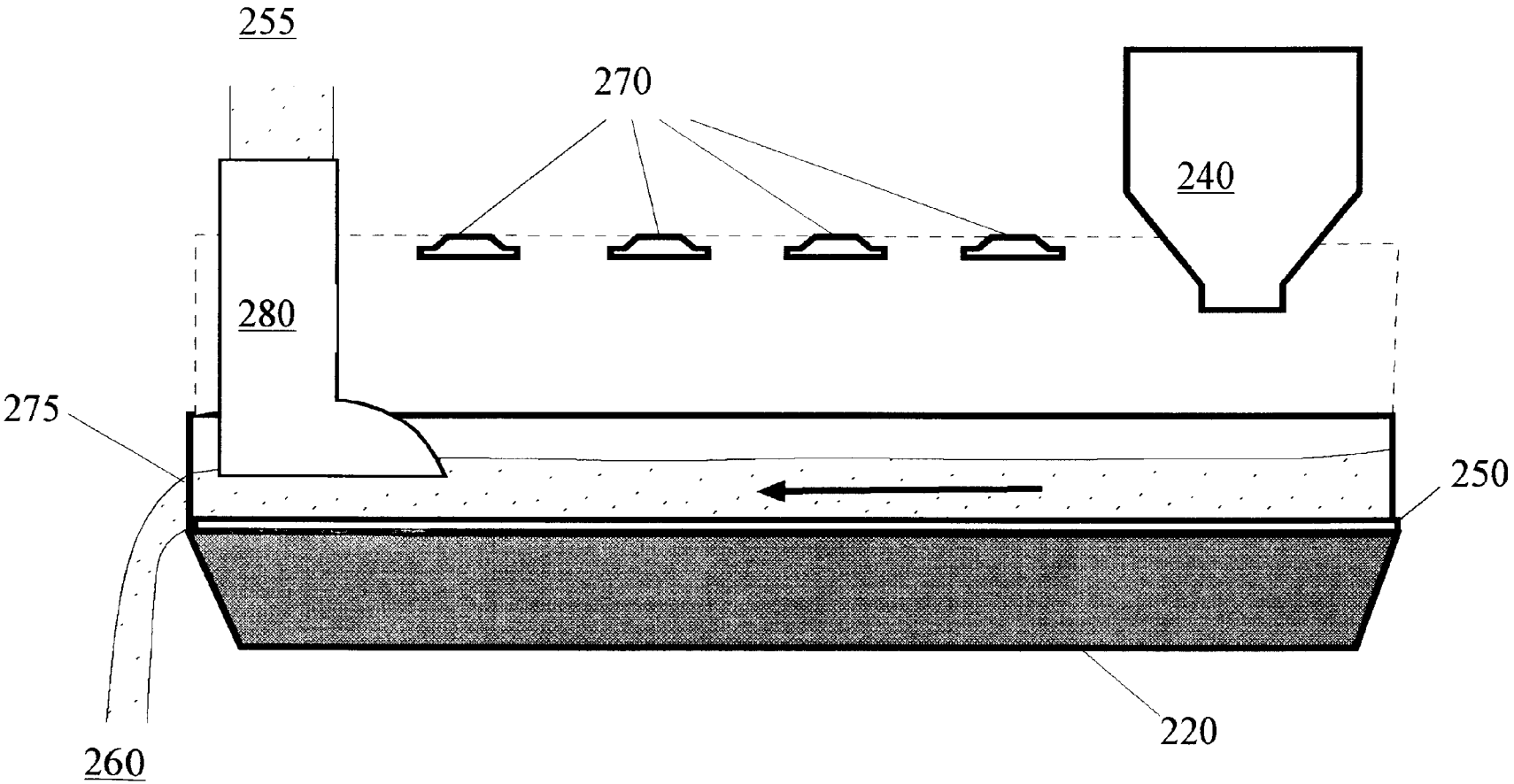

Alternatively, as shown in FIG. 8C, the high LOI material 255 can be removed from the top of the bed by a pneumatic suction device 280, the low LOI material 260 continuing past device 280 to discharge 275.

Figure 8D:
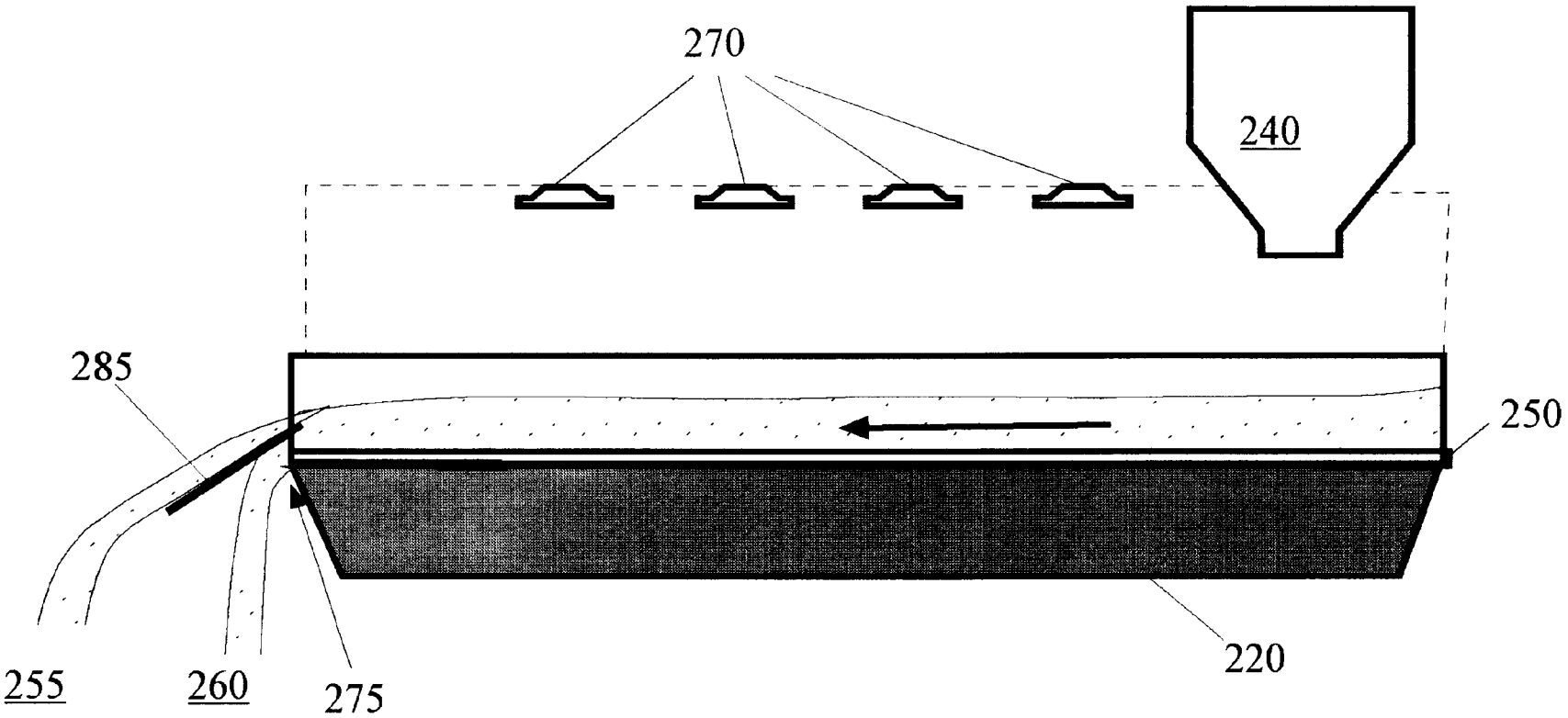

Employing yet another existing removal process shown in FIG. 8D, a splitter plate 285 can be used to separate the high LOI component 255 from the low LOI component 260 as they are both discharged from the other end at discharge 275.

The inclined fluidized beds shown in FIGS. 8A–D may be fit between the precipitator or fabric filter and ash silo in a typical pulverized coal power plant for continuous operation.

Figure 9:
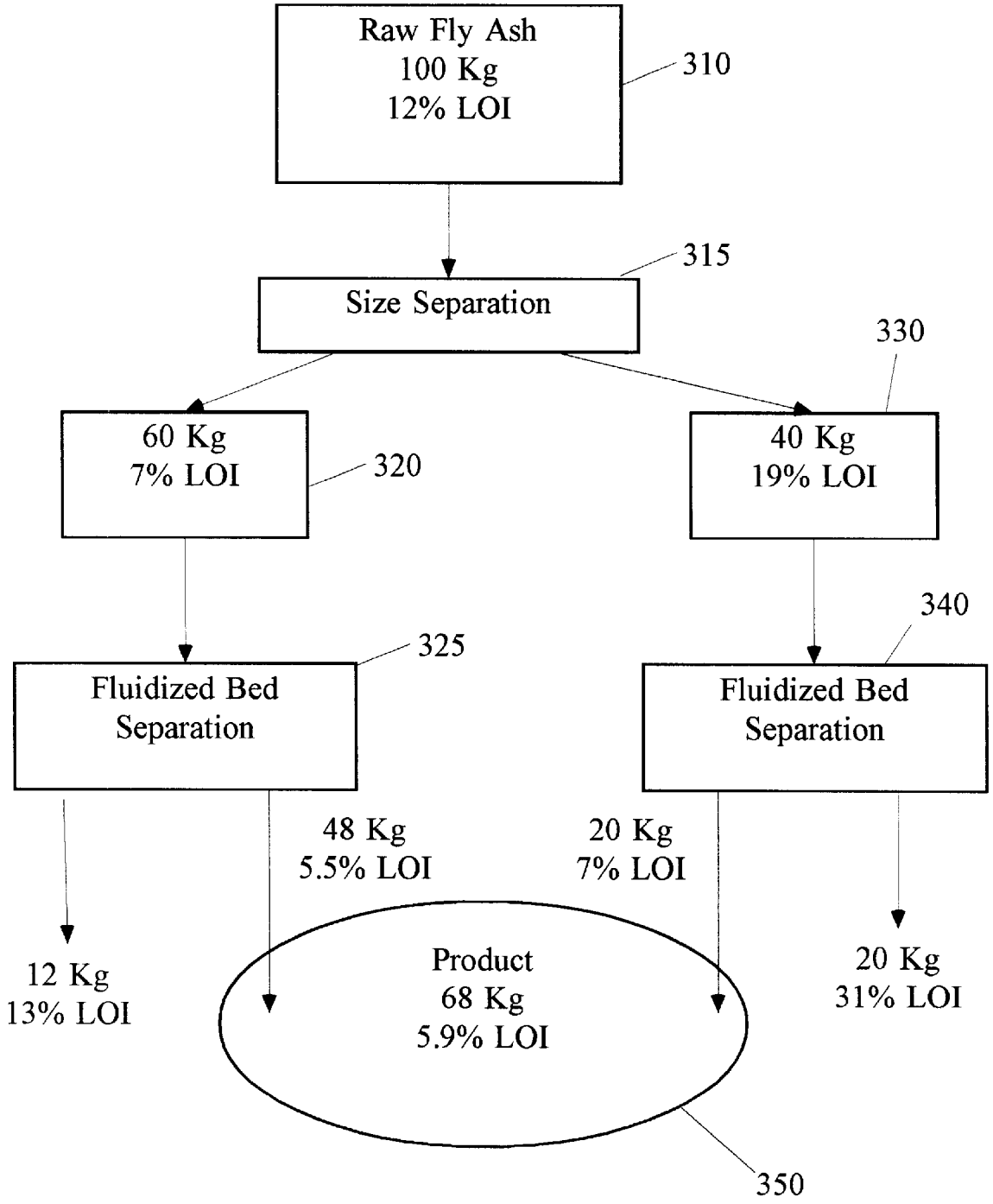
FIG. 9 is a flow diagram illustrating the separation process in accordance with a second embodiment of the present invention in which both of the separated components are processed through two bubbling fluidized beds.

FIG. 9 is a flow diagram illustrating the separation process in accordance with a second embodiment of the present invention in which both of the separated components are processed through two bubbling fluidized beds. Again, beginning with the raw fly ash (e.g., 100 kg at 12% LOI) at step 310, the process entails initial classification of the fly ash by size at step 315. The fly ash is classified and separated into two components, including a fine component at step 320 comprising approximately 60 kg of 7% LOI fly ash, and a coarse component at step 330 having typically higher levels of unburned carbon on the order of 19% LOI. The fine fly ash classified at step 320 is processed through a first bubbling fluidized bed at step 325, and is then sent directly to the ash product bin at step 350. The coarse, high carbon, fly ash from step 330 is processed through a second bubbling fluidized bed at step 340. Preferably, loudspeakers 270 (as in FIG. 6) are employed in conjunction with one or both fluidized beds to add acoustic excitation, as was described more fully above. The resulting coarse upgraded fly ash is then mixed with the upgraded fine, low carbon fly ash stream at step 350 to produce a final product with the characteristics shown. Both fluidized beds employed at steps 325 and 340 may be as shown and described with respect to FIGS. 8A–D.

Experiments have been performed using a six-inch diameter fluidized bed operating in the batch mode with acoustic excitation as described above. Samples of fly ash were sieved, with the +325 mesh fraction added to the bed, fluidized with air, and the air and sound then abruptly shut off. The fly ash was then removed from the bed vessel, layer by layer, and analyzed for LOI.

Figure 10:
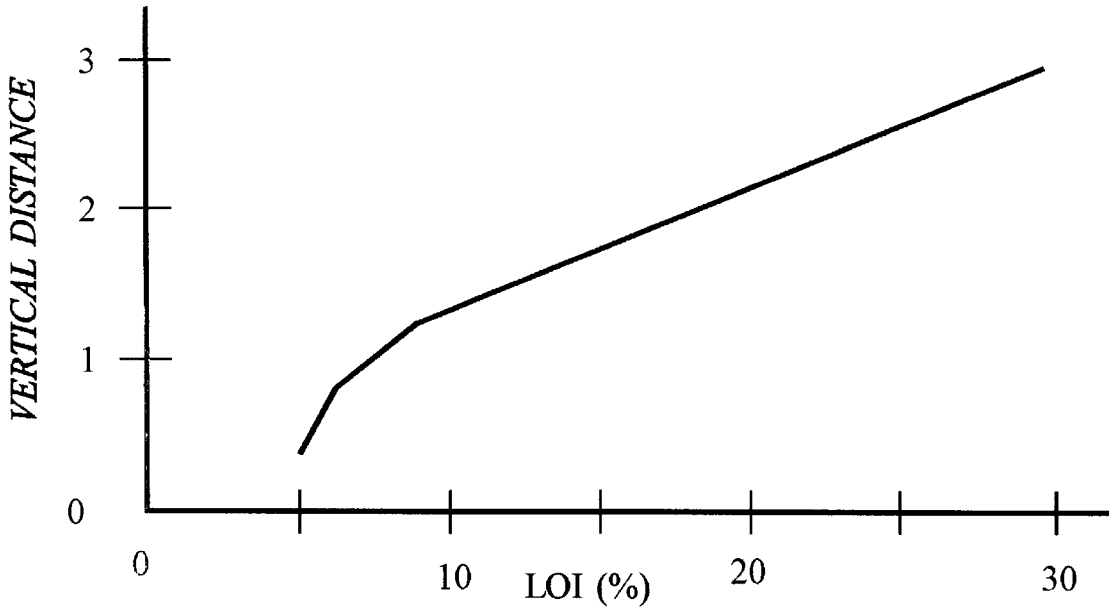
FIG. 10 shows the typical variation of weight percent LOI in fly ash as a function of the vertical distance from the distributor.
Figure 11:
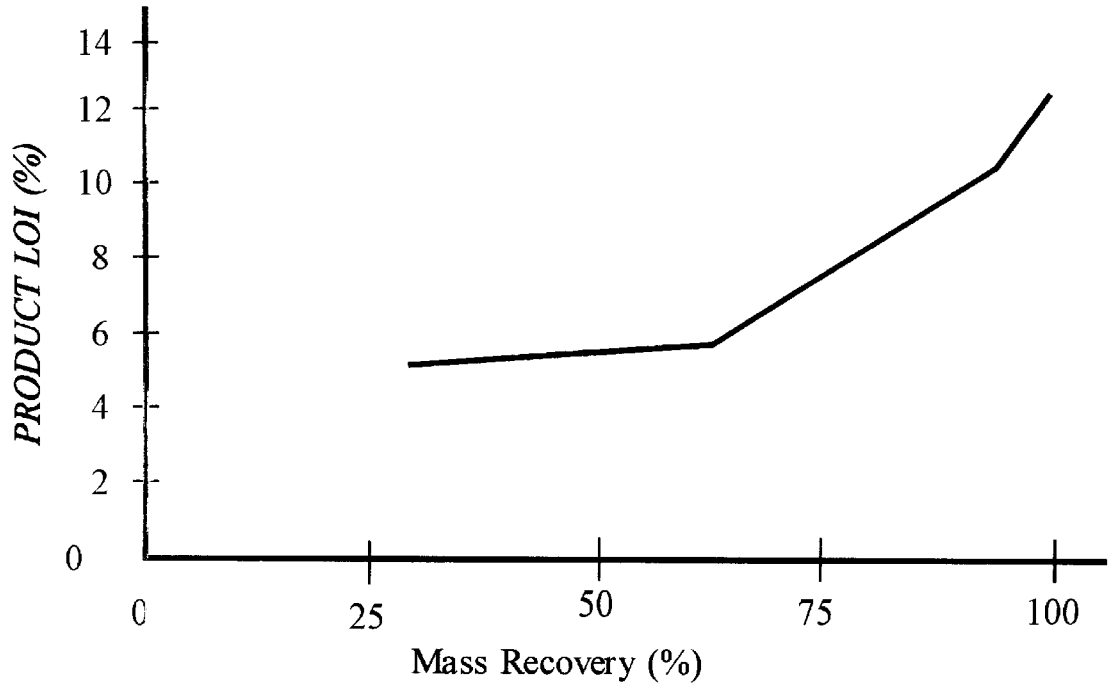
FIG. 11 shows the typical variation of weight percent LOI in the final product as a function of the percentage mass recovery thereof.

The results are shown in FIGS. 10 and 11, which are graphical illustrations of the strong segregation patterns which result from fluidizing the ash.

FIG. 10 shows the typical variation of weight percent LOI in fly ash as a function of the vertical distance from the distributor.

FIG. 11 shows the typical variation of weight percent LOI in the final product as a function of the percentage mass recovery thereof.

The experiments show that the degree of stratification which occurs is a strong function of the size distribution of the fly ash, the distribution of carbon by size, and bed operating conditions. The overall percent reduction in carbon depends on the product recovery rate.

In the particular case shown in FIG. 11, a reduction in LOI of close to 50 percent was achieved with a 65 percent ash recovery rate.

Figure 12:
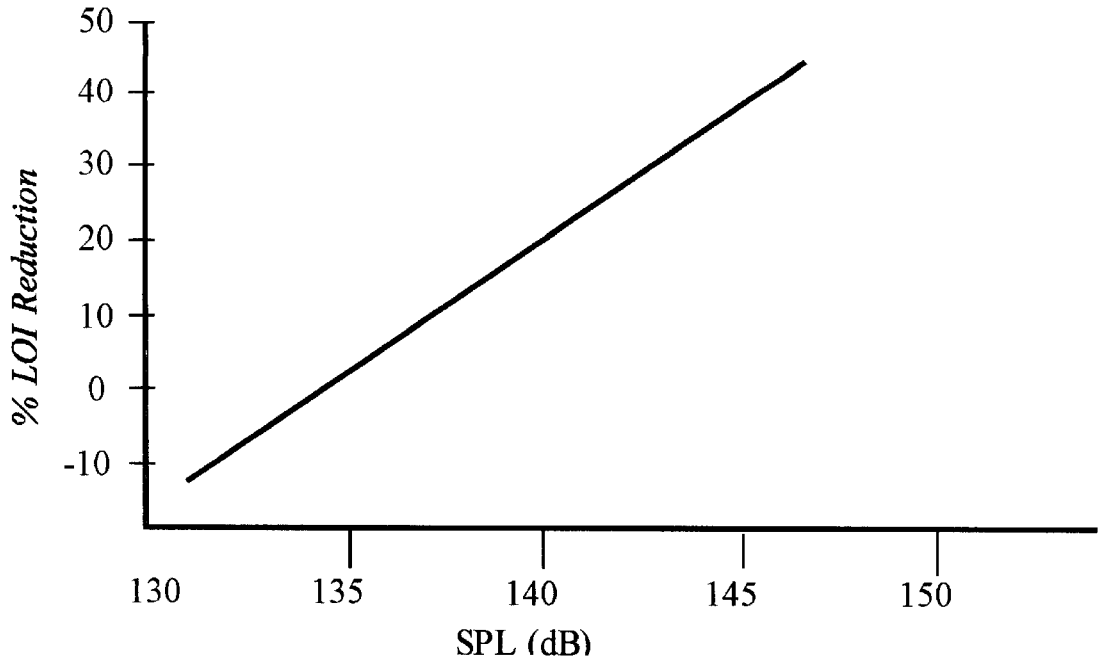
FIG. 12 illustrates percentage LOI reduction as a function of the Sound Pressure Level (SPL).

FIG. 12 illustrates for one set of experiments how the percentage LOI reduction increased as the Sound pressure Level (SPL) increased from 130 to 145 dB.

Figure 13:
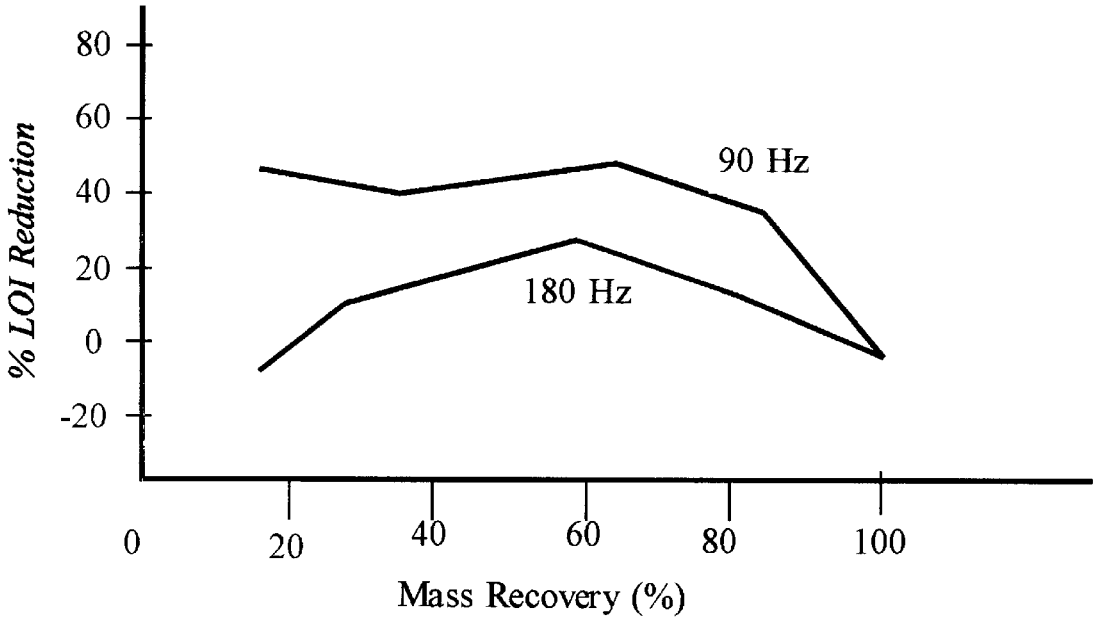
FIG. 13 illustrates percentage LOI reduction as a function of sound frequency (Hz).

FIG. 13 illustrates the effect of sound frequency, showing how sound frequencies of 180 and 90 Hz demonstrated much larger reductions in LOI at 90 Hz.

In conjunction with all of the above-described processes and devices, additional supplemental methods may be employed for improving the fluidization properties of fine cohesive particles, and these may include vibrating the bed mechanically, pulsing the fluidizing air, and adding extremely fine powders to the bed to reduce interparticle forces.

Having now fully set forth a detailed example and certain modifications incorporating the concept underlying the present invention, various other modifications will obviously occur to those skilled in the art upon becoming familiar with said underlying concept. It is to be understood, therefore that within the scope of the appended claims, the invention may be practiced otherwise than as specifically set forth herein.

We claim:

1. A process for separating different types of dry particulates from a dy mixture, comprising the steps of:

introducing a mixture of different types of dry particulates into an inclined fluidized bed;

processing said mixture along said fluidized bed to achieve bubbling fluidization of said dry particles and thereby cause segregation by which a dense fraction settles downward and a light fraction rises upward in said bed, said processing step including acoustic enhancement whereby an acoustic field is imposed on said fluidized bed to improve fluidization and segregation of said particles; and separating said dense fraction from said light fraction.

2. The process according to claim 1, wherein said acoustic enhancement further comprises imposing an acoustic field by at least one speaker mounted above said fluidized bed.

3. A process for separating different types of dry particulates from a dry mixture, comprising the steps of:

separating said different types of dry particulates by size into a plurality of components, including at least a fine component and a coarse component;

processing at least one of said coarse component and said fine component along a first inclined fluidized bed to achieve bubbling fluidization of said particles and thereby cause segregation by which a dense fraction settles downward and a light fraction rises upward in said bed, said processing step including acoustic enhancement whereby an acoustic field is imposed on said first fluidized bed to improve fluidization and segregation of particles;

removing said dense fraction from said at least one processed component to thereby produce an upgraded processed component; and recombining said at least one upgraded processed component with other components to produce a final product.

4. The process according to claim 3, wherein said step of processing at least one of said coarse component and said fine component further comprises processing said coarse component in said first inclined fluidized bed to produce an upgraded coarse component.

5. The process according to claim 4, wherein said step of processing at least one of said coarse component and said fine component further comprises processing said fine component in a second inclined fluidized bed and removing a dense fraction therefrom to produce an upgraded fine component; and said step of recombining further comprises recombining said upgraded coarse component with said upgraded fine component to produce a final product.

6. The process according to claim 5, wherein said step of processing said fine component along said second inclined fluidized bed includes acoustic enhancement whereby an acoustic field is imposed on said second fluidized bed to improve fluidization and segregation of particles.

7. The process according to claim 5, wherein the acoustic enhancement employed during said processing steps further comprises imposing an acoustic field on both of said first and second fluidized beds by at least one speaker mounted above each one of said beds.

8. A process for separating different types of dry particulates from a dry mixture, comprising the steps of:

separating said different types of dry particulates by size into a plurality of components, including at least a fine component and a coarse component;

processing said coarse component in a first inclined fluidized bed to achieve bubbling fluidization of said particles and thereby cause segregation by which a dense fraction settles downward and a light fraction rises upward in said bed, said processing including acoustic enhancement whereby an acoustic field is imposed on said first fluidized bed to improve fluidization and segregation;

processing said fine component in a second inclined fluidized bed to achieve bubbling fluidization of said particles and thereby cause segregation by which a dense fraction settles downward and a light fraction rises upward in said bed, said processing including acoustic enhancement whereby an acoustic field is imposed on said second fluidized bed to improve fluidization and segregation;

removing said dense fraction from said coarse component to thereby produce an upgraded coarse component;

removing said dense fraction from said fine component to thereby produce an upgraded fine component;

recombining said upgraded coarse component with said upgraded fine component to produce a final product.

9. A process for separating unburned carbon from dry raw fly ash, comprising the steps of:

separating dry raw fly ash by size into a plurality of components, including at least a fine component and a coarse component, said coarse component having typically higher levels of unburned carbon;

processing at least one of said coarse component and said fine component along a first inclined fluidized bed to achieve bubbling fluidization of said particles and thereby cause segregation by which a dense fraction settles downward and a light fraction rises upward in said bed, said processing step including acoustic enhancement whereby an acoustic field is imposed on said first fluidized bed to improve fluidization and segregation of particles;

removing said dense fraction from said at least one processed component to thereby produce an upgraded processed component having lower levels of unburned carbon; and recombining said at least one upgraded processed component with other components to produce a final product having lower levels of unburned carbon.

10. The process according to claim 9, wherein said step of processing at least one of said coarse component and said fine component further comprises processing said coarse component in said first inclined fluidized bed to produce an upgraded coarse component.

11. The process according to claim 10, wherein said step of processing at least one of said coarse component and said fine component further comprises processing said fine component in a second inclined fluidized bed and removing a dense fraction therefrom to produce an upgraded fine component; and said step of recombining further comprises recombining said upgraded coarse component with said upgraded fine component to produce a final product having lower levels of unburned carbon.

12. The process according to claim 11, wherein said step of processing said fine component along said second inclined fluidized bed includes acoustic enhancement whereby an acoustic field is imposed on said second fluidized bed to improve fluidization and segregation of particles.

13. A process for separating unburned carbon from dry raw fly ash, comprising the steps of:

separating raw fly ash by size into a plurality of components, including at least a fine component and a coarse component, said coarse component having typically higher levels of unburned carbon;

processing said coarse component in a first inclined fluidized bed to achieve bubbling fluidization of said particles and thereby cause segregation by which a dense fraction settles downward and a light fraction rises upward in said bed, said processing including acoustic enhancement whereby an acoustic field is imposed on said first fluidized bed to improve fluidization and segregation;

processing said fine component in a second inclined fluidized bed to achieve bubbling fluidization of said particles and thereby cause segregation by which a dense fraction settles downward and a light fraction rises upward in said bed, said processing including acoustic enhancement whereby an acoustic field is imposed on said second fluidized bed to improve fluidization and segregation;

removing said dense fraction from said coarse component to thereby produce an upgraded coarse component having lower levels of unburned carbon;

removing said dense fraction from said fine component to thereby produce an upgraded fine component having lower levels of unburned carbon;

recombining said upgraded coarse component with said upgraded fine component to produce a final product.

14. An acoustically enhanced fluidized bed for separating unburned carbon from dry raw fly ash, comprising:

means for introducing raw dry fly ash;

a distributor extending lengthwise along said fluidized bed for supporting said raw fly ash;

an air plenum for bubbling air up through the raw fly ash via said distributor;

at least one speaker mounted above said fluidized bed for enhancing its ability to fluidize and segregate;

whereby said raw fly ash traverses said fluidized bed and a reduced unburned carbon component settles downward toward said distributor while an increased unburned carbon component rises upward; and means for separating said reduced unburned carbon component from said increased unburned carbon component.

15. The acoustically enhanced fluidized bed for separating unburned carbon from raw dry fly ash according to claim 14, wherein said means for separating said reduced unburned carbon component from said increased unburned carbon component further comprises a plurality of slots in said distributor.

16. The acoustically enhanced fluidized bed for separating unburned carbon from raw dry fly ash according to claim 14, wherein said means for separating said reduced unburned carbon component from said increased unburned carbon component further comprises a pneumatic suction device for removing the fine component from the top of the bed.

17. The acoustically enhanced fluidized bed for separating unburned carbon from raw dry fly ash according to claim 14, wherein said means for separating said reduced unburned carbon component from said increased unburned carbon component further comprises a splitter plate for separating the reduced unburned carbon component from said increased unburned carbon component during discharge from the fluidized bed.

* * * * *